US009453626B2

(12) United States Patent
Ruiz Bonet

(10) Patent No.: US 9,453,626 B2
(45) Date of Patent: Sep. 27, 2016

(54) DECORATIVE LAMP WITH RELAXING ACTION

(71) Applicant: Hernán Ruiz Bonet, Barcelona (ES)

(72) Inventor: Hernán Ruiz Bonet, Barcelona (ES)

( * ) Notice: Subject to any disclaimer, the term of this patent is extended or adjusted under 35 U.S.C. 154(b) by 59 days.

(21) Appl. No.: 14/421,257

(22) PCT Filed: May 21, 2013

(86) PCT No.: PCT/IB2013/054175
§ 371 (c)(1),
(2) Date: Feb. 12, 2015

(87) PCT Pub. No.: WO2014/027256
PCT Pub. Date: Feb. 20, 2014

(65) Prior Publication Data

US 2015/0198299 A1 Jul. 16, 2015

(30) Foreign Application Priority Data

Aug. 17, 2012 (ES) ..... 201230886

(51) Int. Cl.
*F21S 10/00* (2006.01)
*G09F 19/02* (2006.01)
(Continued)

(52) U.S. Cl.
CPC ..... *F21S 10/00* (2013.01); *F21V 14/08* (2013.01); *G09F 19/02* (2013.01); *G09F 19/12* (2013.01); *F21Y 2101/02* (2013.01); *G09F 2013/222* (2013.01)

(58) Field of Classification Search
CPC .. G09F 19/02; G09F 19/12; G09F 2013/222; F21S 10/00; F21S 10/007; F21S 10/02; F21S 10/026; F21S 10/063; F21Y 2101/02; F21V 14/08; F21V 1/10; F21V 13/00; F21V 14/00; F21V 14/06; F21V 14/006
See application file for complete search history.

(56) References Cited

U.S. PATENT DOCUMENTS 3,686,494 A * 8/1972 Naylor ..... F21S 10/06 362/811
5,685,097 A 11/1997 Marinov et al.
(Continued)

FOREIGN PATENT DOCUMENTS

CN 201748322 2/2011
CN 202178033 3/2012

OTHER PUBLICATIONS

PCT International Preliminary Report on Patentability in PCT/IB2013/054175, dated Feb. 17, 2015, 5 pages.
(Continued)

*Primary Examiner* — Bao Q Truong
(74) *Attorney, Agent, or Firm* — Servilla Whitney LLC

(57) ABSTRACT

It comprises a fixed element (110) with a first pattern(P), an element (120) movable relative to the fixed element (110) with a second pattern (P), and a LED light source (150). At least one of the patterns (P) has different light transmission properties defining intersection areas between the patterns (P), which allow for the light to pass through at certain intensities, thus simultaneously creating a combination of a first effect and a second effect in operation. The first effect is the movement of various light points on the exterior visible surface of the lamp (100), and the second effect is the projection of a pattern of moving light to the outside of the lamp (100). The areas of intersection between the patterns are points or lines and/or define text and/or graphics.

15 Claims, 3 Drawing Sheets

(51) Int. Cl.

| | |
|---|---|
| ***G09F 19/12*** | (2006.01) |
| ***F21V 14/08*** | (2006.01) |
| *G09F 13/22* | (2006.01) |
| *F21Y 101/02* | (2006.01) |

(56) References Cited

U.S. PATENT DOCUMENTS

| | | | | |
|---|---|---|---|---|
| 6,584,713 | B2 * | 7/2003 | Huang | G09F 19/02 362/811 |
| 7,003,906 | B1 * | 2/2006 | Yang | G09F 19/02 362/811 |
| 8,695,247 | B1 * | 4/2014 | Yang | G09F 13/24 362/101 |
| 2002/0105808 | A1 * | 8/2002 | Ting Yup | F21S 10/02 362/281 |
| 2003/0184831 | A1 | 10/2003 | Liebermann | |
| 2008/0025026 | A1 | 1/2008 | Lee et al. | |

OTHER PUBLICATIONS

PCT International Search Report in PCT/IB2013/054175, mailed Oct. 4, 2013, 3 pages.

PCT International Written Opinion in PCT/IB2013/054175, mailed Oct. 4, 2013, 4 pages.

* cited by examiner

DECORATIVE LAMP WITH RELAXING ACTION

CROSS-REFERENCE TO RELATED APPLICATIONS

This is the U.S. National Phase entry of International Application No. PCT/IB2013/054175, filed May 21, 2013, which claims priority to Spanish Application No. 201230886, filed Aug. 17, 2012, the disclosures of which are both incorporated herein in their entireties.

The present invention relates to a decorative lamp with relaxing action according to the preamble of claim 1.

BACKGROUND OF THE INVENTION

The use of light for decorative and relaxing purposes is well-known in the art. The film industry has created, for example, visual effects by projecting a light source from an incandescent lamp on photoliths incorporating a certain pattern.

Lamps intended for the projection of a certain shape formed in a laminar body, also by means of an incandescent lamp, are also known. Document US2003184831 describes an example of this kind of lamp. The lamp described in such document consists of a white light source and a device for driving an outer cylinder in rotation. An inner cylinder covering the light source and which is provided with strips that can be coloured is also arranged. The configuration of this inner cylinder radially directs light upwards, thus producing a hologram.

Although these known means are effective to provide decorative visual effects for a mainly aesthetic application, the use of incandescent light sources in combination with certain motifs does not provide effects of chromatic or dynamic richness that apart from being decorative, they can be considered as relaxing.

SUMMARY OF THE INVENTION

The invention proposes a decorative lamp according to claim 1, of simple configuration and economical structure with which a relaxing effect can be provided.

The lamp according to the invention comprises a fixed element having a first pattern and an element movable relative to said fixed element having a second pattern. At least one of the movable element and the fixed element may be laminar elements. The movable element may have an outer surface arranged in the vicinity of an inner surface of the fixed element, for example in contact therewith, although in some cases the fixed element and the movable element can be arranged by leaving a gap between them. In some embodiments an outside support element also serving as protective element of the elements of the lamp may be arranged too.

According to the invention, the term pattern, as used herein, refers to a chaotic and disorganized arrangement of a set of lines and areas with different transmission properties of the light therein.

The lamp according to the invention further includes a LED (light emitting diode) light source. This LED light source can be in the form of a flexible strip having a plurality of individual LEDs distributed along it. The advantage of placing a strip of LEDs is that it can be helically wound around a central support ensuring uniform illumination of the light allowing the intensity to be easily adjusted by varying the helix pitch. Furthermore, the use of a LED light source is much more efficient than the use of an incandescent light. The LED light source represents a considerable energy saving and offers many more control options than traditional light sources. The LED light source of the lamp according to the present invention can be of the RGB type or it can be of the monochrome LED type.

Other configurations for the LEDs of the light source are not ruled out within the scope of the invention. For example, these could be arranged in small bunches to be inserted into bulbs, in plates of various shapes and configurations to place them in spotlights or fluorescent light bases, etc.

In RGB LEDs, white light and any other composed colour is obtained by mixing LEDs in three basic colours: red, green and blue. Each of these colours is adjustable, with the possibility of varying the colour and intensity at will. Through a pre-established programming, mixing of colours and cadence and intensity of variation of each LED can be controlled remotely as desired, for example through a remote control. Thus, the user can remotely generate, in a convenient and easy way, the entire range of colours and different types of oscillations, such as stroboscopic effect, colour flashes, gradual darkening, etc. This is an advantage over known lamps, based on incandescent bulbs, in which the white light has a constant light temperature and can only be separated into basic colours by using a transparent prism.

According to an important aspect of the present invention, at least one of said first and second patterns of said fixed and mobile elements has different light transmission properties therein. Thus, in operation, intersection areas between the first pattern and the second pattern are defined. These intersection areas allow light to pass through at certain intensities creating a combination of a first effect and a second effect different from the first one. In operation, these first and second effects are produced simultaneously. The first effect generated by the lamp consists of the movement of various light points on its outer visible surface. The second effect generated by the lamp consists of the projection of a pattern of moving light to the outside of the lamp. The combination of these two effects provides a pleasant projection which at the same time is relaxing.

These effects are achieved by the interaction of intersection areas between patterns with different properties of light transmission in combination with the use of a LED light source. The result is a decorative ambient light that, in operation, is able to create, in addition, a gentle and pleasing multi-coloured light. The lamp described induces a state of relaxation and clears the mind of people looking at either of the two light effects, as if s(he) were staring at the movement of sea waves or the movement of fire flames.

The LED light source of the RGB type of the lamp described may also be configured to emit white light as described above. In this mode, there are transparent points that move on the observer's line of sight of which one or two can hide from the three LEDs that make up each RGB chip for a fraction of a second. Thus, the perception of colour changes for a brief moment, so that white colour becomes blue, red or green colour, or any combination of pairs of the three colours. The effect is very similar to that produced by looking at the reflections in a gemstone. It is a false refraction, but the optical effect is virtually identical.

The LED light source of the RGB type used for this lamp can also be configured to operate in any mode of composed colour. For example in the golden light mode, only the red and green LEDs are on. In this mode, most of the points are appreciated as golden but flashes of red colour points and green colour points will shine among them.

The lamp of the invention may operate in a basic colour mode. In this basic colour mode, only one of the three RGB (red, green or blue) LED components is on in order to vary the effect of false diffraction or even not to produce it. However, high colour intensity flashing may occur when the observer's line of sight crosses through the transparent point directly to the LED. This effect further enhances the chromatic shades of the lamp.

The lamp of the invention may work in monochrome colour mode. In this case, the above effect is perceived even more clearly.

In addition to the projection modes mentioned, the lamp of the invention is capable of providing other lighting effects. In dark conditions, the lamp is able to produce a projection of a swinging curtain of lights and shadows of very soft colour tones on the walls of the place where it is located, for example in a room or in a bedroom. This effect is similar to the reflection of moonlight on the sea. As all the effects mentioned above, the intensity of this effect can be easily adjusted by the user.

Preferably, the fixed element or the movable element is formed by lines of different properties of light transmission. Furthermore, it is preferred that the areas of intersection between a pattern and the other are points and/or lines. These intersection areas can define text and/or graphics. Thanks to this feature, the lamp of the invention can be advantageously used to project visual information for advertising purposes.

The fixed element and the movable element of the lamp may have a cylindrical configuration in a mutual concentric arrangement, i.e., the one arranged within the other, the one being surrounded by the other. In this configuration, the LED light source can be arranged in a holder mounted on the inside of said elements. The cylindrical arrangement of the fixed and movable elements allows minimizing the space required and, at the same time, providing an elegant column of light. Furthermore, this configuration increases the depth and range of lighting effects as it creates a vanishing point effect on the sides of the column. The present invention, however, is not limited to this configuration, and the fixed element and the movable element could present an alternative configuration, such as planar, spherical or any other suitable configuration provided that one of the elements can move relative to the other, for example in rotation.

The pleasant and relaxing effect obtained by the lamp described according to the invention is ensured by the particular configuration of the patterns of the fixed element and the movable element that has been described. This special configuration is such that at least part of at least one of said patterns is disorganized and/or chaotic. Patterns can be conveniently formed by lines that do not follow a geometric design and therefore lack of any recognizable arrangement. The arrangement of the lines defining at least part of one or both of such patterns seeks to create movements that are pleasing and/or surprising to the user, in the points resulting from the intersection of those lines of the patterns.

For the movement of the movable element, the lamp incorporates motor means. The motor means may be any known in the art, although it is preferred to use at least a geared motor. This geared motor should be suitable for driving the movable element relative to the fixed element in rotation. In one embodiment of the lamp of the invention, the fixed element is arranged outside the mobile element. The geared motor allows rotating the movable element very slowly and with a quiet operation. In this way, it is achieved that the flow of light points moving in all directions with a very low average speed generates a captivating effect for the observer.

The visual effect resulting from the interaction of the fixed element and the movable element with the LED light source is highly advantageous for the purposes of the invention, i.e., to provide a relaxing visual effect to the user's eyes. The relative rotation of the elements with patterns provided with chaotic and disorganized lines, in conjunction with LED lighting, is such that the user only perceives light points in certain areas where the lines cross. This causes the arising of a set of moving points that follow an individual dynamics that is determined by the configuration of said patterns in the fixed and mobile elements.

The described advantages of the lamp are advantageously obtained by a very simple structure and configuration and consequently with an economic set.

Further objects, advantages and features of embodiments of the lamp of the invention will become apparent to those skilled in the art upon the description, or may be learned by practice of the invention.

BRIEF DESCRIPTION OF THE DRAWINGS

A preferred embodiment of the lamp of the present invention will be now described. This embodiment is given only by way of merely illustrative and not limiting example. The present description of the lamp is given with reference to the accompanying drawings.

In said drawings.

DETAILED DESCRIPTION OF A PREFERRED EMBODIMENT

Figure 1:
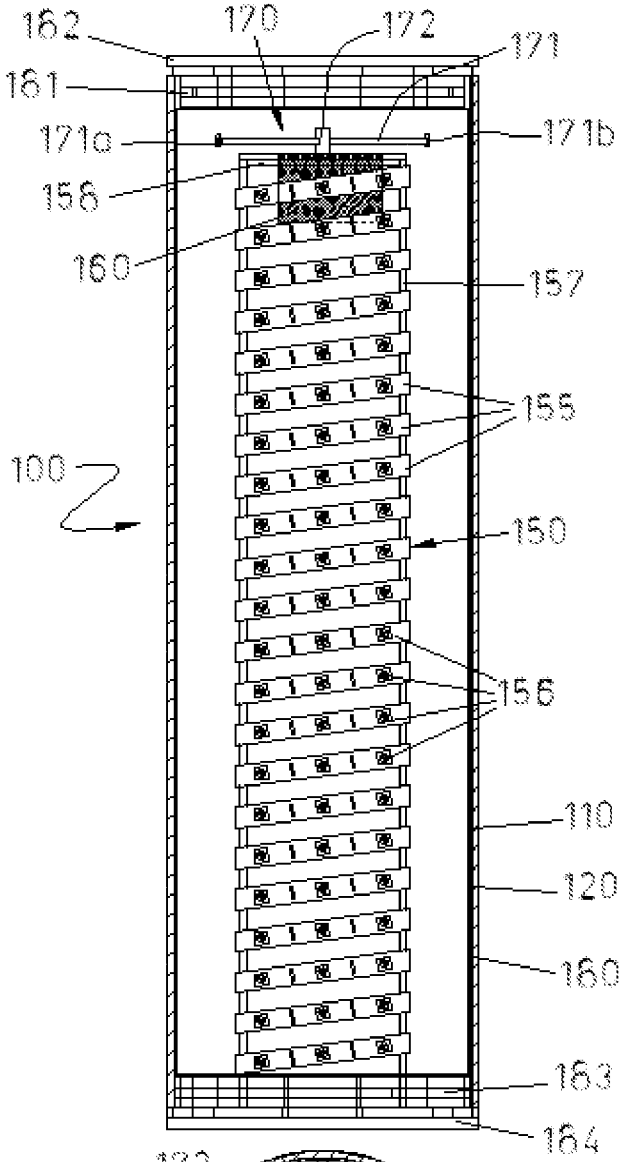
FIG. 1 is a sectional elevational view of a possible exemplary embodiment of a lamp according to the present invention.

One example of an ambient decorative lamp according to the invention with reference to accompanying FIGS. 1-4 is described in the following. When the described ambient light is activated, a nice gentle multicolour light of relaxing effect for the user is obtained.

In the enclosed figures, the example of decorative lamp according to the invention has been designated as a whole by the reference numeral 100. In the example illustrated in FIGS. 1 and 2, the decorative lamp 100 comprises a fixed element 110 and a movable element 120.

Figure 3:
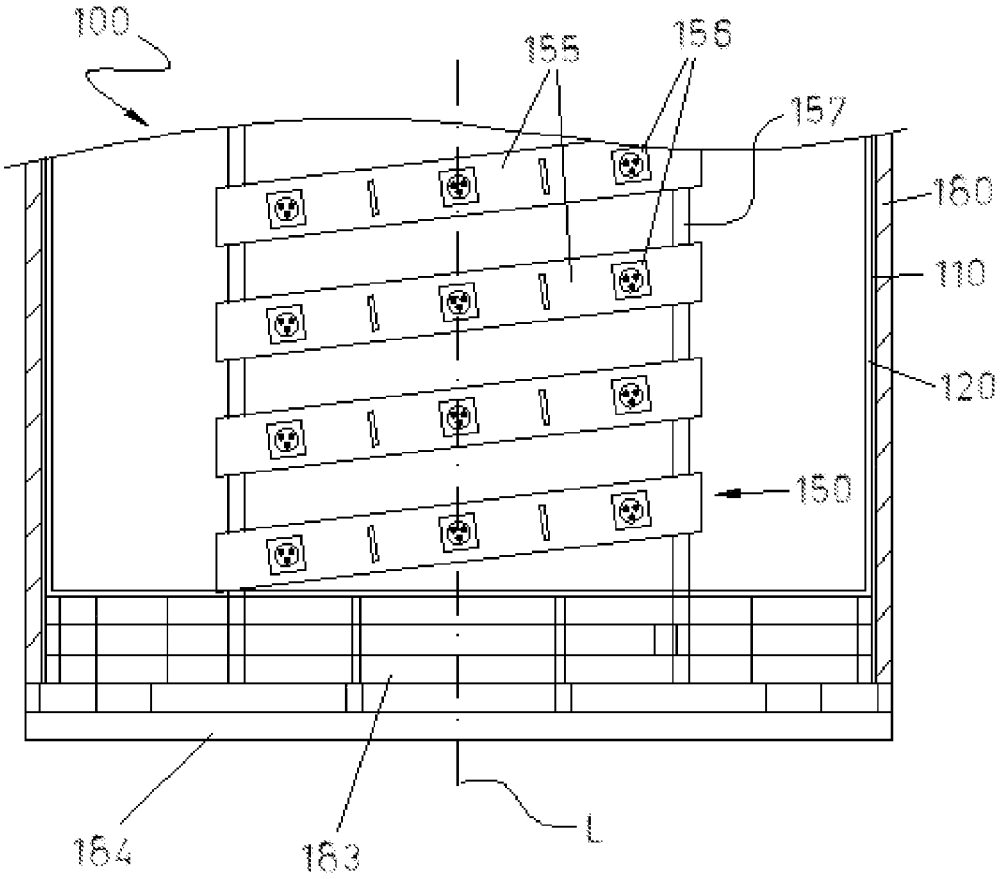
FIG. 3 is a detailed partial enlarged elevation view of the lamp according to FIG. 1.
Figure 4:
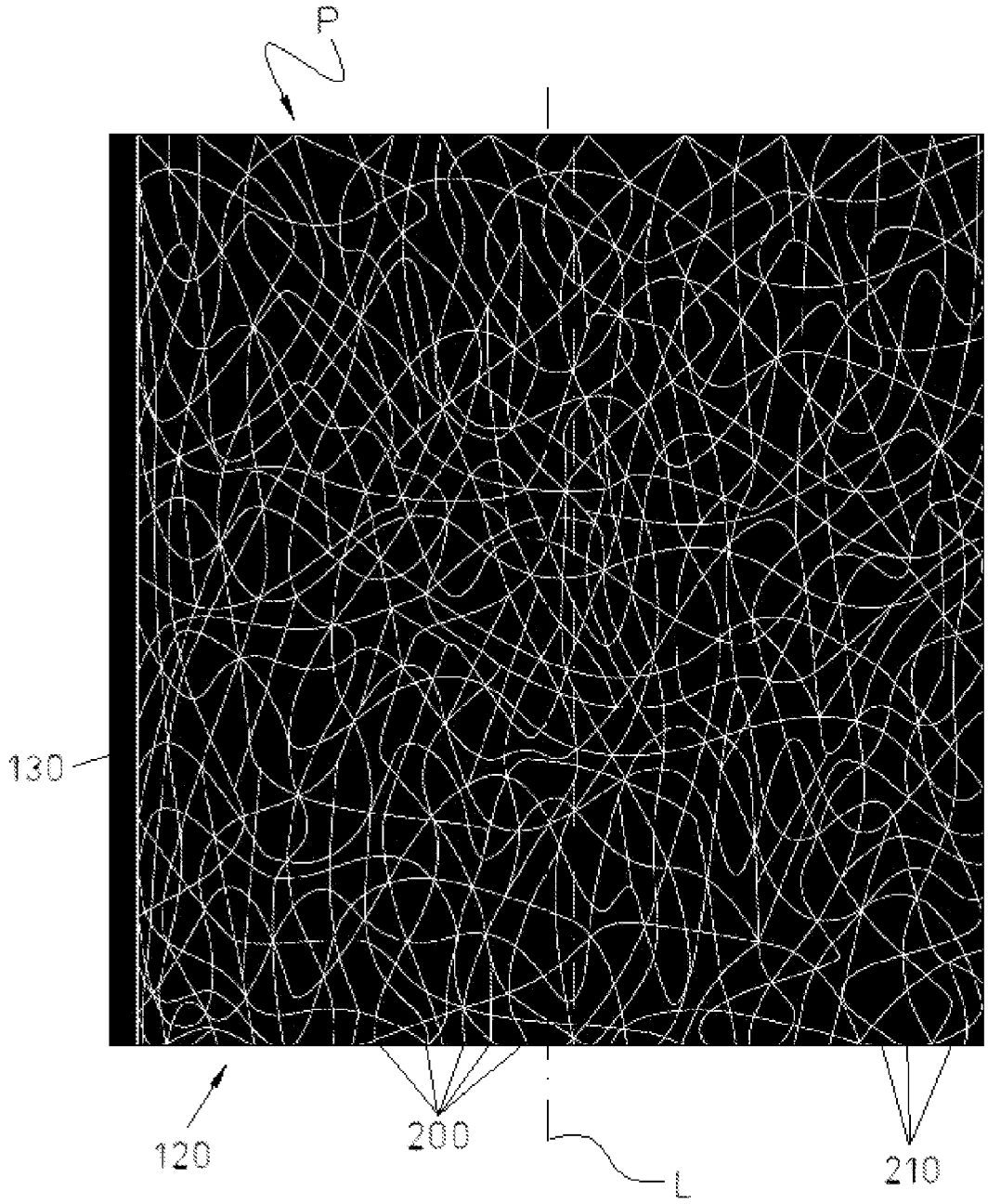
FIG. 4 is a schematic view of an example of a pattern associated with the movable element of the lamp of FIG. 1.

In this particular embodiment which is described and illustrated, the fixed element 110 and the movable element 120 are two cylindrical laminar bodies, with respective longitudinal axis L (see FIGS. 3 and 4 of the drawings). Other geometric configurations are possible within the scope of the invention, provided that an element is able to move relative the other. In this case, a cylindrical configuration of the fixed element 110 and the movable element 120 is preferred because it takes up very little space. The fixed element 110 and the movable element 120 may be, for example, photoliths. The plane development of the fixed element 110 and the movable element 120 includes a lateral longitudinal strip 130 at one end. This longitudinal strip 130 allows to close each of these elements 110, 120 and to form respective cylindrical bodies, as shown in FIG. 4. In one example, this longitudinal strip 130 may be a transparent adhesive strip.

The movable element 120 of the lamp 100 is arranged inside the fixed element 110, as can be seen in the detailed enlarged view of FIG. 3. The fixed element 110 is thus arranged outside, completely surrounding the mobile element 120 which is inside of it. The movable element 120 is mounted rotatably around its longitudinal axis L, with respect to the fixed element 110.

The fixed element 110 and the movable element 120 of the lamp 100 are both arranged with their longitudinal axes L matching. However, the fixed element 110 and the movable element 120 can be arranged with their longitudinal axes L mismatched, or even non-parallel with respect the one another.

The two elements 110, 120 are arranged substantially in contact with each other, namely the movable element 120 has an outer surface in contact with an inner surface of the fixed element 110. Within the scope of the invention it is perfectly possible a configuration wherein a gap exists between the fixed element 110 and the movable element 120.

The fixed element 110 has a first pattern P and the movable element 120 has a second pattern P. FIG. 4 shows a non-limiting example of a pattern P for the movable element 120 for a 50 cm height lamp. The pattern P here is the same for both elements 110, 120, but it could be different, providing equally pleasant and relaxing effect in both cases. Each pattern P is formed by a plurality of lines 200 which define areas 210. These lines 200 may be formed, for example, by screen printing. In the example of FIG. 4, the lines 200 of the pattern P are substantially transparent, whereas areas 210 of the pattern P are substantially opaque. In general, the lines 200 and the areas 210 of the pattern P have different light transmission properties.

Patterns P could be one reversed relative to the other such that, despite being equal, their designs do not match. By arranging them in this way, they could only coincide in case of having any symmetrical element in the design for the lines pattern, which is expressly avoided in the preferred case. What is sought is an absence of recognizable patterns P in the movement of the light points. The creation of these symmetrical elements can be useful, for example, in advertising applications. In other embodiments of the lamp 100 of the invention, the patterns P of inner and outer elements 110, 120 may be completely different.

As can be seen in the example of FIG. 4, the pattern P has a configuration of disorganized and chaotic lines 200. This disorganized and chaotic configuration or distribution does not follow any particular geometric design, but it is formed with the intention of creating pleasant and surprising movements at the points resulting from the intersection of those lines 200 and areas 210 of the patterns P of both elements P 110, 120 of the lamp 100.

The above-mentioned intersection of lines 200 and areas 210 of the patterns P of the elements 110, 120 may be partial in the line of sight, that is, only from some of the red, green, blue colours, or total, producing, in this case, white light. The areas of intersection between a pattern P and another pattern P can be points, lines, graphics, etc. This can be configured and combined in specific applications to define text and/or graphics, which can be very useful for advertising purposes, for example, to generate all kinds of high-impact visual messages.

Inside the fixed element 110 of the lamp 100 a LED light source 150 of the RGB type is arranged. In other alternative embodiments of the lamp 100 of the invention, the LED light source may be of monochrome type. In the case of the embodiment using a LED light source 150 of the RGB type, the three basic colours (red, green and blue) can be regulated independently of one another. The colour and intensity can be varied at will very easily and remotely through a (not shown) remote control.

Figure 2:
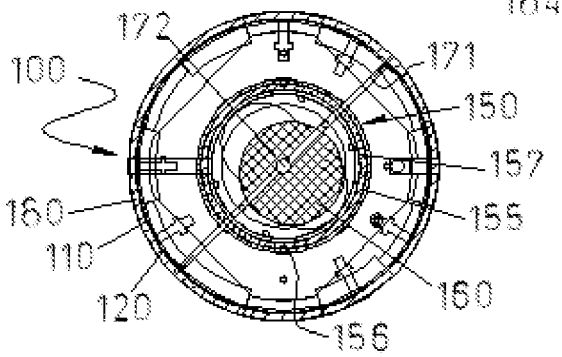
FIG. 2 is a plan view of the embodiment of the lamp of FIG. 1.

The LED light source 150 of the lamp 100 comprises a flexible strip 155 having a plurality of LEDs 156 distributed therealong. The LEDs 156 arranged on the flexible strip 155 may be distributed substantially aligned, as shown in FIGS. 2 and 3, but although they alternatively could be misaligned, in curved arrangements, with a chaotic layout or any other suitable arrangement, provided that the described relaxing effect is provided. The flexible strip 155 with LEDs 156 distributed thereon is arranged inside the lamp 100, helically wound around a central support tubular member 157. This central support tubular member 157 is arranged inside the fixed element 110 in the embodiment shown.

The non-limiting example illustrated corresponds to a 50 cm high vertical tubular lamp, as indicated. It is clear that other heights and dimensions are possible. In this particular case a light source 150 formed by a 5 meters long flexible strip 155 of LEDs 156 of the RGB type is used. For the distribution of the LEDs 156 that is used in this example, the total power of the light source 150 is 35 W. The flexible nature of the strip 155 allows arranging the LEDs 156 suitably wound around the support tube 157, as indicated. This configuration of the LEDs 156 helically wound allows ensuring a homogeneous illumination in any direction of the lamp body 100. Furthermore, with this configuration the LEDs density can be easily adjusted by varying the pitch of the helix of the strip 155 of LEDs 156. The invention, however, is not limited to this arrangement of the type with helically arranged flexible strip but any spatial distribution of independent LEDs is contemplated.

The lamp 100 described according to the figures has a geared motor 160, as can be seen in FIG. 1. The geared motor 160 is arranged on top of the tubular support 157 of the strip 155 of LEDs 156. The geared motor 160 is adapted to drive, via a suitable transmission means 170, the movable element 120.

The transmission means 170 mentioned above are formed, in the embodiment shown, by a bar 171. The bar 171 is arranged substantially perpendicular to the shaft 172 of the geared motor 160. The bar 171 is attached to the shaft 172 of the geared motor 160 in a central region thereof. The opposite ends 171*a*, 171*b* of the bar 171 are attached respectively to opposite portions of the inner surface of the movable element 120.

In operation, when the user activates the lamp 100, either through a switch on the lamp 100 itself (not shown) or remotely via a remote control (not shown), the geared motor 160 rotates the bar 171, which in turn slowly and quietly rotates the movable element 120 relative to the fixed element 110. This rotation of the movable element 120 by means of the geared motor 160 in combination with the actuation of the RGB LED light source 150 simultaneously produces two relaxing effects, which are described hereinafter.

A support disc 158 is arranged on top of the LED light source 150. This support disc 158 has the function of supporting the geared motor 160 with the bar 171 of the transmission means 170 for driving the mobile element 120 of the lamp 100.

The lamp 100 of the embodiment shown by way of example in the Figures also includes a cylindrical outer support element 180. The cylindrical support element 180 is made of methacrylate and it is arranged in the outside of the lamp 100, around the fixed element 110 and the movable element 120.

In the uppermost portion of the lamp 100 an upper aeration element 181 formed by a series of disks is arranged. Also in this upper part of the lamp 100 a closing cover 182 is arranged. Similarly, in the lower portion of the lamp 100 a lower aeration element 183 formed by a series of discs, and a lower base element 184 are arranged, as shown in FIG. 1.

As indicated above, the rotation of the movable element 120 relative to the fixed element 110, both with their patterns P, in combination with the driving of the RGB LED light source 150 simultaneously produces two relaxing effects. In particular, the relative rotation of the patterns P formed in said elements 110, 120 define areas of intersection formed by the intersection of chaotic and disorganized lines for each of said patterns P of said elements 110, 120. These areas of intersection that are defined at certain moments of the operation of the lamp 100, in certain relative angular positions of said elements 110, 120, allow for the passage of light in determined intensities. Only at those points where the lines intersect, light points generated by a pattern of moving points following a rhythmic pattern determined by the configuration of the two cited patterns P are noticeable. As a result, a flow of light points moving in all directions with a very low average and non-uniform speed is obtained. The non-uniformity of the speed of the light point flow is due to the different angle adopted by the lines of the pattern P at each instant in the operation of the lamp 100. Thus, the speed of the light point flow is smaller if the angle between the lines has a value close to 180°, while the speed of the light point flow is higher if the angle between the lines has a value close to 90°.

The design of the patterns P, that is, the configuration of the lines that form it (see example in FIG. 4) allows for a pleasing effect formed by the combination of a first effect and a second effect, as indicated above. Both effects occur simultaneously when the elements 110, 120 rotate while the lamp 100 is in operation. The first effect consists of the movement of various light points on the exterior visible surface of the lamp 100. The second effect consists of the projection of a pattern of moving light to the outside of the lamp 100. If LED light of the RGB type is used a refraction phenomenon is obtained. If LED light of the monochrome type is used, the obtained phenomenon is a variation of the intensity on the light points. In both cases a projection of a dynamic image to the outside is always produced.

This combined effect can be properly regulated by means of a suitable programming. By means of, for example, a remote control (not shown), the user can control the colour mixing and the cadence and intensity of variation of each LED, generating the full range of colours and different kinds of variations such as the stroboscopic type, colour flashes, gradual darkening, etc.

Although only a number of particular embodiments and examples of the lamp of the invention has been described herein, it will be understood by those skilled in the art that other alternative embodiments and/or uses of the lamp of the invention as well as obvious modifications and equivalent elements thereof are possible. For example, the light source of the lamp may be rotatable. Moreover, the outer fixed element or the cylindrical outer support element could not completely cover certain elements of the lamp.

The present invention covers all possible combinations of the specific embodiments which have been described. The scope of the present invention should not be limited to specific embodiments, but should be determined only by a fair reading of the claims that follow.

The invention claimed is:

1. A decorative lamp with relaxing action, comprising a fixed element having a first pattern, an element movable relative to said fixed element having a second pattern, and a LED light source, characterized in that at least one of said patterns has different properties of light transmission therein, so that, in operation, areas of intersection between the first pattern and the second pattern are defined, which allow the light to pass through at certain intensities creating a combination of a first effect and a second effect occurring simultaneously during operation, the first effect consisting of the movement of various light points on the exterior visible surface of the lamp, and the second effect consisting of the projection of a pattern of moving light to the outside of the lamp.

2. The lamp as claimed in claim 1, wherein the pattern of at least the fixed element or the movable element is formed by lines of different properties of light transmission.

3. The lamp as claimed in claim 1, wherein said areas of intersection between the first pattern and the second pattern are points.

4. The lamp as claimed in claim 1, wherein said areas of intersection between the first pattern and the second pattern are lines.

5. The lamp as claimed in claim 1, wherein said areas of intersection define a text and/or graphics.

6. The lamp as claimed in claim 1, wherein the fixed element and the movable element have a cylindrical configuration in a concentric arrangement the one relative to the other.

7. The lamp as claimed in claim 1, wherein the fixed element and the movable element have a planar configuration.

8. The lamp as claimed in claim 1, wherein the fixed element and the movable element have a spherical configuration.

9. The lamp as claimed in claim 1, wherein at least part of at least one of said patterns is disorganized and/or chaotic.

10. The lamp as claimed in claim 1, wherein the movable element is rotatable relative to the fixed element.

11. The lamp as claimed in claim 1, which includes driving means to drive the movable element with respect to the fixed element.

12. The lamp as claimed in claim 1, wherein the movable element has an outer surface arranged close to the inner surface of the fixed element.

13. The lamp as claimed in claim 1, wherein at least one of the movable element and the fixed element is a laminar element.

14. The lamp as claimed in claim 1, wherein said LED light source is of the RGB type.

15. The lamp as claimed in claim 1, wherein said LED light source is monochrome LED.

* * * * *